US010297411B1

(12) United States Patent
Bommersheim et al.

(10) Patent No.: US 10,297,411 B1
(45) Date of Patent: May 21, 2019

(54) MODULAR SINGLE BOLT FUSE HOLDER

(71) Applicant: Littelfuse, Inc., Chicago, IL (US)

(72) Inventors: Hermann Bommersheim, Langenfeld (DE); Patric Gross, Pyrbaum (DE); Geoff Schwartz, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 15/877,463

(22) Filed: Jan. 23, 2018

(51) Int. Cl.
*H01H 85/20* (2006.01)

(52) U.S. Cl.
CPC .... *H01H 85/2005* (2013.01); *H01H 85/2045* (2013.01); *H01H 2085/209* (2013.01); *H01H 2085/2065* (2013.01)

(58) Field of Classification Search
CPC ..... H01H 85/2005; H01H 85/2045; H01H 2085/2055; H01H 2085/2065; H01H 2085/2075; H01H 2085/208; H01H 2085/209
USPC ..... 337/208
See application file for complete search history.

(56) References Cited

U.S. PATENT DOCUMENTS 5,645,448 A * 7/1997 Hill ..... H01H 85/205 439/522
6,030,257 A * 2/2000 Furuya ..... H01H 85/2045 439/620.26
2002/0031924 A1* 3/2002 Davis ..... H01R 9/2491 439/76.2
2004/0252446 A1* 12/2004 Friedrich ..... H01H 85/2045 361/600
2013/0028683 A1* 1/2013 I ..... B60R 16/0238 411/166
2014/0305693 A1* 10/2014 Greenberg ..... H02G 3/08 174/559
2017/0345604 A1* 11/2017 Shah ..... H01H 85/0411
2017/0358418 A1* 12/2017 Carnick ..... H01H 85/0241

* cited by examiner

*Primary Examiner* — Jacob R Crum

(57) ABSTRACT

Provided herein are modular fuse holders for single bolt fuses. In some approaches, a fuse holder may include a base having a lower wall and a set of sidewalls, the lower wall including a plurality of bolt openings provided therethrough. The fuse holder may further include a cover securable with the base, the cover including an upper wall and a set of outer walls, the outer walls including a plurality of cable openings, wherein the base and the cover define an interior cavity for housing a bolt assembly. In some approaches, the fuse holder may include a busbar atop the lower wall of the base, the busbar including a set of openings aligned with one or more of the bolt openings of the lower wall. In some embodiments, a side cover may extend over some of the plurality of cable openings in the outer wall of the cover.

14 Claims, 7 Drawing Sheets

MODULAR SINGLE BOLT FUSE HOLDER

FIELD OF THE DISCLOSURE

The disclosure relates generally to power distribution assemblies and, more particularly, to a modular fuse holder for single bolt fuses.

BACKGROUND OF THE DISCLOSURE

Components such as fuses, relays, diodes, and the like, are used in automobiles to provide a connection between a power source and various components, such as the starter, generator, and so forth. Fuses are used as circuit protection devices to protect against damage caused by an overcurrent condition. A fuse is constructed to physically open or interrupt a circuit path and isolate electrical components from damage upon the occurrence of specified overvoltage and/or overcurrent conditions in the circuit.

Electrical systems in vehicles typically include a number of fuses to protect electrical circuitry, equipment, and components from damage caused by these conditions. For example, power sources (e.g. batteries) in vehicles utilize a fuse fitted over a terminal bolt to which a ring terminal of an electrical cable is connected. A nut is usually threaded onto the bolt to keep the ring terminal and fuse in position. When an excess current condition exists, the fuse on the terminal bolt protects the components connected to the power source from this excess current. Unintended shorting may occur when the ring terminal comes into direct electrical contact with the bolt rather than through the fuse. To overcome this problem, an insulating nut fitted over the bolt has been used to isolate the fuse and the ring terminal to prevent current from bypassing the fuse and damaging the protected circuit.

Fuses may be provided in a fuse assembly within a housing. An upper or lower housing of the housing assembly may defines apertures, wherein projections extend into the apertures so that an operator may place a fuse into the pair of projections. However, power distribution assemblies including multiple components and multi-part housings are expensive to manufacture and assemble, and lack scalable customization to meet the needs of a various applications.

SUMMARY

In view of the foregoing, embodiments herein provide an improved modular fuse holder for single bolt fuses. In one exemplary approach of the present disclosure, a fuse holder includes a base having a lower wall and a set of sidewalls, the lower wall including a plurality of bolt openings provided therethrough, and a cover securable with the base. The cover may include an upper wall and a set of outer walls, the outer walls including a plurality of cable openings, wherein the base and the cover define an interior cavity for housing a bolt assembly.

Another exemplary approach of the present disclosure includes a circuit protection assembly having a base including a lower wall and a set of sidewalls, the lower wall including a plurality of bolt openings provided therethrough. The circuit protection assembly may further include a cover securable with the base, the cover including an upper wall and a set of outer walls, the outer walls including a plurality of cable openings, wherein the base and the cover define an interior cavity, and a plurality of bolt assemblies extending into the interior cavity.

Yet another exemplary approach of the present disclosure includes a modular fuse holder assembly having a base having a lower wall and a set of sidewalls, the lower wall including a plurality of bolt openings provided therethrough. The modular fuse holder may further include a cover securable with the base, the cover including an upper wall and a set of outer walls, the outer walls including a plurality of cable openings, wherein the base and the cover define an interior cavity, and a plurality of bolt assemblies extending through the lower wall and into the interior cavity.

BRIEF DESCRIPTION OF THE DRAWINGS

Non-limiting embodiments of the present disclosure are described by way of example with reference to the accompanying figures, which are schematic and not intended to be drawn to scale. In the figures, each identical or nearly identical component illustrated is typically represented by a single numeral. For purposes of clarity, not every component is labeled in every figure, nor is every component of each embodiment shown where illustration is not necessary to allow those of ordinary skill in the art to understand the disclosure. In the figures.

Figure 1:
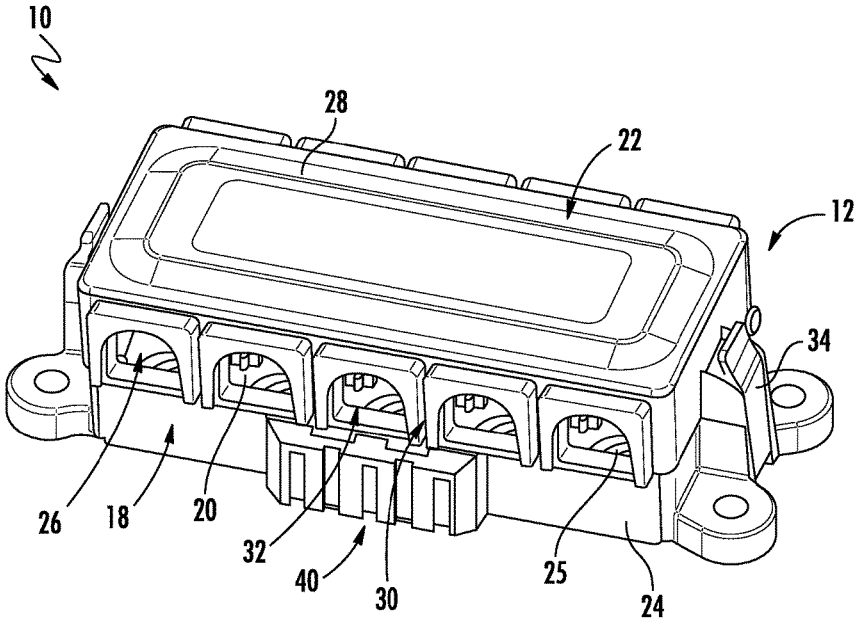
FIG. 1 is a perspective view illustrating a fuse holder according to exemplary embodiments of the disclosure.

Furthermore, certain elements in some of the figures may be omitted, or illustrated not-to-scale, for illustrative clarity. Cross-sectional views may be in the form of "slices", or "near-sighted" cross-sectional views, omitting certain background lines otherwise visible in a "true" cross-sectional view, for illustrative clarity. Furthermore, for clarity, some reference numbers may be omitted in certain drawings.

DETAILED DESCRIPTION

A fuse holder, a circuit protection assembly, and a modular fuse holder assembly in accordance with the present disclosure will now be described more fully hereinafter with reference to the accompanying drawings, in which embodiments of the system and method are shown. The fuse holder, a circuit protection assembly, and modular fuse holder assembly, however, may be embodied in many different forms and should not be construed as being limited to the embodiments set forth herein. Rather, these embodiments are provided so that this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of these components and their constituent parts, each with respect to the geometry and orientation of a modular fuse holder as they appear in the figures. Said terminology will include the words specifically mentioned, derivatives thereof, and words of similar import.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

Approaches herein provide for customized power distribution using a fuse holder for single bolt fuses. In one or more approaches, a fuse holder may include a base having a lower wall and a set of sidewalls, the lower wall including a plurality of bolt openings provided therethrough. The fuse holder may further include a cover securable with the base, the cover including an upper wall and a set of outer walls, the outer walls including a plurality of cable openings, wherein the base and the cover define an interior cavity for housing a bolt assembly. In some approaches, the fuse holder may include a busbar atop the lower wall of the base, the busbar including a set of openings aligned with one or more of the bolt openings of the lower wall. In some embodiments, a side cover may extend over some of the plurality of cable openings in the outer wall of the cover.

One of ordinary skill in the art will appreciate that embodiments herein provide at least the following technical improvements and advantages over the existing art. Firstly, the modular fuse holder assembly allows multiple configurations to be easily attainable at the time of assembly. Even in the case of different overall capacity (e.g., number of fuses) holders, a common flexible architecture is shared. Secondly, press fit isolated bolt assemblies allow multiple configurations, including multiple bolt sizes and locations. Thirdly, using two rows of bolt assembly locations within the housing allows for entry of wires from either side of the housing, while still permitting sufficient strain relief and minimizing overall foot print. Fourthly, a combination side cover (i.e., dust cover) and fuse retainer keeps Z-case fuses in place for transportation without having to add a nut and lock washer. This saves labor on the installation side as the wires can be placed on the fuses and nuts tightened without having to remove all of the nuts first. Fifthly, flexible busing allows multiple configurations with common components. Sixthly, a dovetail feature along an exterior of the housing allows multiple fuse holders to be coupled together and bussed together.

Figure 2:
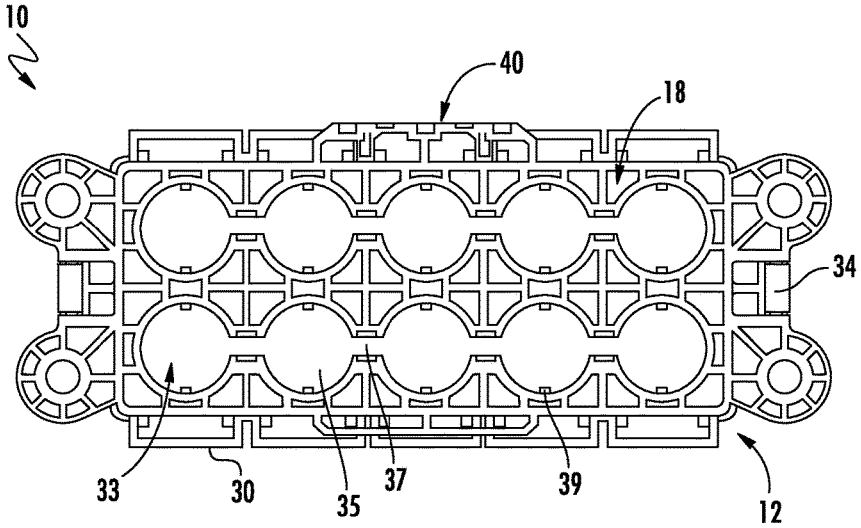
FIG. 2 is a bottom view of the fuse holder shown in FIG. 1 according to exemplary embodiments.
Figure 3:
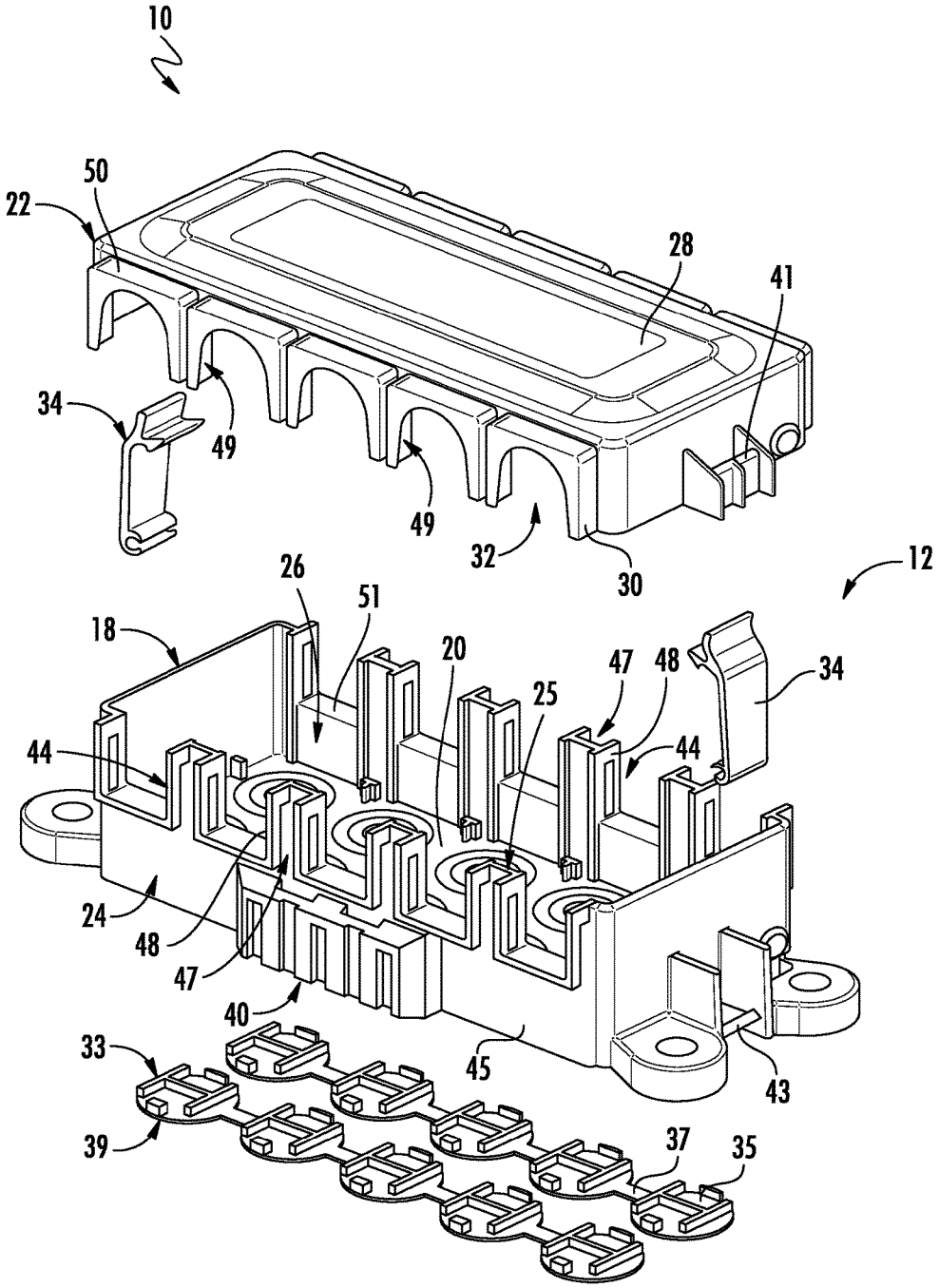
FIG. 3 is an exploded view of the fuse holder shown in FIG. 1 according to exemplary embodiments of the disclosure.
Figure 4:
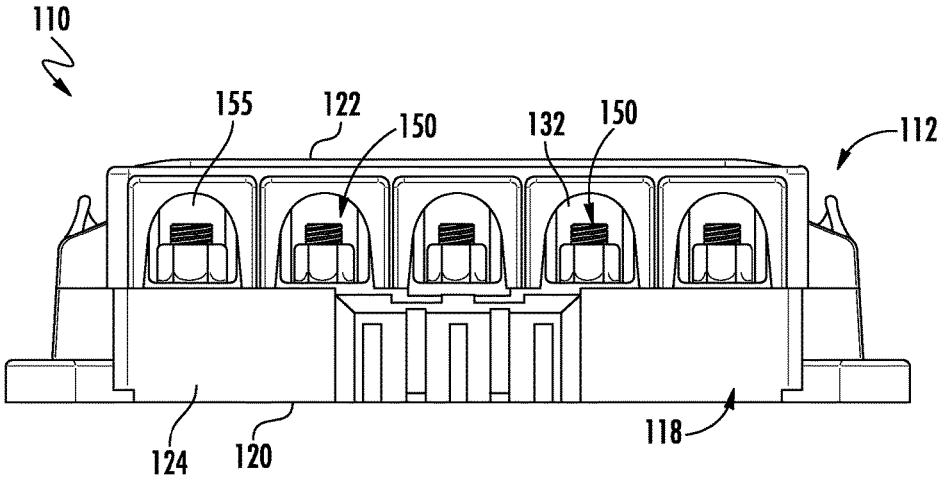
FIG. 4 is a side view illustrating a fuse holder according to exemplary embodiments of the disclosure.
Figure 5:
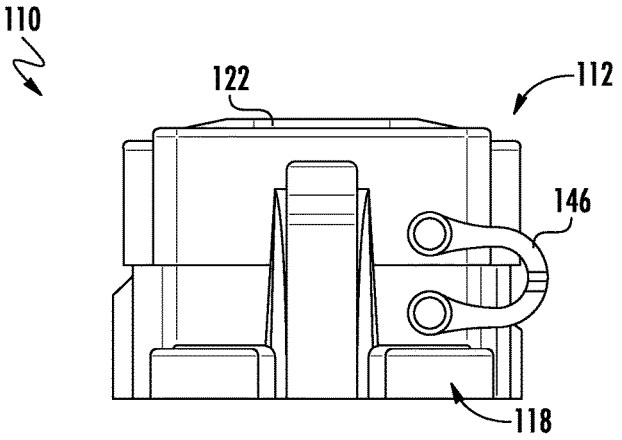
FIG. 5 is an end view of the fuse holder shown in FIG. 4 according to exemplary embodiments.

Referring to FIGS. 1-3, an exemplary embodiment of a modular fuse holder assembly (hereinafter, assembly 10) in accordance with the present disclosure is shown. The assembly 10 includes a housing assembly 12 having a base 18 coupled to a cover 22, the cover 22 removably connected to the base 18 and covering the components therein. The cover 22 can be removed, for example, to replace one or more fuse components. As shown, the base 18 may include a lower wall 20 and a set of sidewalls 24 extending from the lower wall 20. In some embodiments, the set of sidewalls 24 extend perpendicularly from an upper surface of the lower wall 20. The lower wall 20 may include a plurality of bolt openings 25 provided therethrough. As will be described in greater detail below, the plurality of bolt openings 25 permit one or more bolt assemblies to extend into a cavity 26 defined by an open area within the base 18 and the cover 22.

The assembly 10 may further include one or more lower capping strips 33 coupled to a bottom side of the base 18. As shown, the lower capping strips 33 may having alternating circular opening plugs 35 and linking members 37, wherein the circular opening plugs 35 are configured to cover the plurality of bolt openings 25 in the lower wall 20. In some embodiments, the lower capping strips 33 may be snap-fit into position by one or more undercut features 39 securable to corresponding mating lips (not shown) within each bolt opening 25.

As further shown, the cover 22 may include an upper wall 28 and set of outer walls 30, the set of outer walls 30 including a plurality of cable openings 32 to permit one or more cables (i.e., wires) to enter the housing assembly 12 for connection with the bolt assemblies. In some embodiments, the cable openings 32 may have an arched or semicircular shape. Other shapes and dimensions for the cable openings 32 are possible within the scope of the present disclosure.

In some embodiments, the cover 22 may be snap-fit to the base 18 and/or include one or more brackets or latches 34 to releasably secure the cover 22 to the base 18. In an alternative embodiment, the cover 22 is threaded onto the base 18 and can include a spring seal that provides a tensile force against the cover 22, which tends to hold the cover 22 in a tight, threaded relationship with the base 18 even when the vehicle is moving and creating vibrations that could otherwise loosen the cover 22. The spring mechanism can also provide a seal between the cover 22 and the base 18. Although not specifically illustrated, the cover 22 may also include means to further facilitate grasping and removal, such as tabs, projections, recesses, etc.

The base 18 may include a sidewall interlocking feature 40 for mounting multiple housing assemblies together. In some embodiments, the sidewall interlocking feature 40 may include one or more dovetail-type members. Although not limited to any particular material, the housing assembly 12 may be made of an insulating material, such as plastic, which is molded to form a demonstrated shape. In some embodiments, the base 18 and the cover 22 can be made of the same or different materials, such as an insulating plastic, e.g., nylon, glass-filled nylon, polyester and polycarbonate.

In some embodiments, the latches 34 may be coupled to a pin 42 (FIG. 3) of the base 18, to permit the latches 34 to pivot about an axis defined by the pin 42. When the cover 22 is not in use, the latches 34 may rotate and extend away from the cover 22. Then, as the cover 22 is positioned onto the base 18, the latches 34 may be rotated towards the cover 22, and clamped about a securement ridge 41 of the cover 22.

As best shown in FIG. 3, the housing assembly 12 may include a set of interlocking features for coupling the cover 22 to the base 18. For example, the base 18 may include a plurality of pillar supports 44 extending upwardly from a lower portion 45 of the set of sidewalls 24. Each of the pillar supports 44 may include a pair of outer flanges 48 defining a middle slot 47 therebetween. The middle slot 47 is configured to receive one or more opening walls 49 of the cover 22. During securement of the housing assembly 12, the opening walls 49 may be inserted into the middle slot 47 until an interior surface of an upper wall 69 engages the pair of outer flanges 48.

Referring now to FIGS. 4-7, an exemplary embodiment of another modular fuse holder assembly (hereinafter, assembly 110) in accordance with the present disclosure is shown. As shown, the assembly 110 includes many of the features previously described in relation to the assembly 10 of FIGS. 1-3 and, as such, may not be described in full detail for the sake of brevity. The assembly 110 includes a housing assembly 112 having a base 118 coupled to a cover 122, the cover 122 removably connected to the base 118 and covering the components therein. As shown, the base 118 may include a lower wall 120 and a set of sidewalls 124 extending from the lower wall 120. In some embodiments, the set of sidewalls 124 extend perpendicularly from an upper surface of the lower wall 120. The lower wall 120 may include a plurality of bolt openings 125 (FIG. 6) provided therethrough. The plurality of bolt openings 125 permit one or more studs or bolt assemblies 150 to extend into a cavity 126 defined by an open area within the base 118 and the cover 122. In some embodiments, the cover 122 may be attached to the base 118 by a tether 146, which may be a looped silicon rubber connector coupled to each of the base 118 and the cover 122.

As shown, the assembly 110 includes one or more bolt assemblies 150 (e.g., Ni/Sn plated steel) extending through the plurality of bolt openings 125, as well as through a plurality of bus openings 151 of a busbar 152. For example, the bottom side of the base 118 may include recesses sized slightly larger than the heads of each bolt assembly 150 within which these heads are disposed such that the respective bolts are secured in position through the lower wall 120. The bolt assemblies 150 may be force fit into respective recesses of the bolt openings 125, wherein the bolt openings 125 have the same shape as respective heads of each bolt assembly 150 with body portions of each of the bolt assemblies 150 extending through lower wall 120. In this manner, the bolt assemblies do not need to be integrally molded with the base 118, thereby reducing manufacturing and labor costs.

The busbar 152 may be disposed atop the lower wall 120 of the base 118, wherein the plurality of bus openings 151 are aligned with one or more of the plurality of bolt openings 125 of the lower wall 120. In some embodiments, the bolt assemblies 150 may be secured to the busbar 152 by corresponding nuts 153. Furthermore, the busbar 152 may be secured to the top surface of the lower wall 120 of the base by one or more fasteners 154 (e.g., press-fit tabs) extending from the lower wall 120 of the base. During use, the bolt assemblies 150 supply power to the busbar 152, the bolt assemblies 150 being configured to receive fuses (not shown). Once the bolt assemblies 150 are inserted into the housing assembly 112, one or more capping strips 135 may be inserted into the plurality of bolt openings 125 in the lower wall 120. It will be appreciated that bolts of various size and position may be employed.

The assembly 110 may further include a side cover 155 coupleable with the base 118, the side cover 155 configured to extend between at least one of the plurality of cable openings 132 in the outer wall 130 of the cover 122, as well as over at least one of a plurality of openings 158 defined by each of a plurality of pillar supports 144 of the base 118. As shown, the side cover 155 may include a plurality of channels 156 configured to receive and surround corresponding pillar supports 144. More specifically, each of the side covers 155 may include one or more slotted side walls 180 slidably engaged with corresponding outer flanges 148 of the pillar supports 144. In some embodiments, extending between each of the plurality of channels 156 is a central block 157 arranged within openings 158 between each of the plurality of pillar supports 144. The side cover 155 may include a set of tabs 160 for engaging a channel 161 of one or more of the plurality of pillar supports 144 to secure the side cover 155 to the base 118.

As will be appreciated, the side cover 155 may act as a debris cover for minimizing intrusion of dust or other contaminants into the cavity 126. In some embodiments, the side cover 155 may be a series of unconnected components arranged side by side, enabling flexible, interchangeable placement over the openings 158 between each of the pillar supports 144. In other embodiments, the side cover 155 may be a continuous piece of material (e.g., silicon rubber) covering all of the plurality openings 158.

After the side cover 155 is coupled to the base 118, the cover 122 may be placed atop the base 118. That is, the middle slot 147 of each pillar support 144 is configured to receive one or more opening walls 149 of the cover 122. The opening walls 149 may be inserted into the middle slot 147 until an interior surface of an upper wall 169 engages the pair of outer flanges 148.

Figure 6:
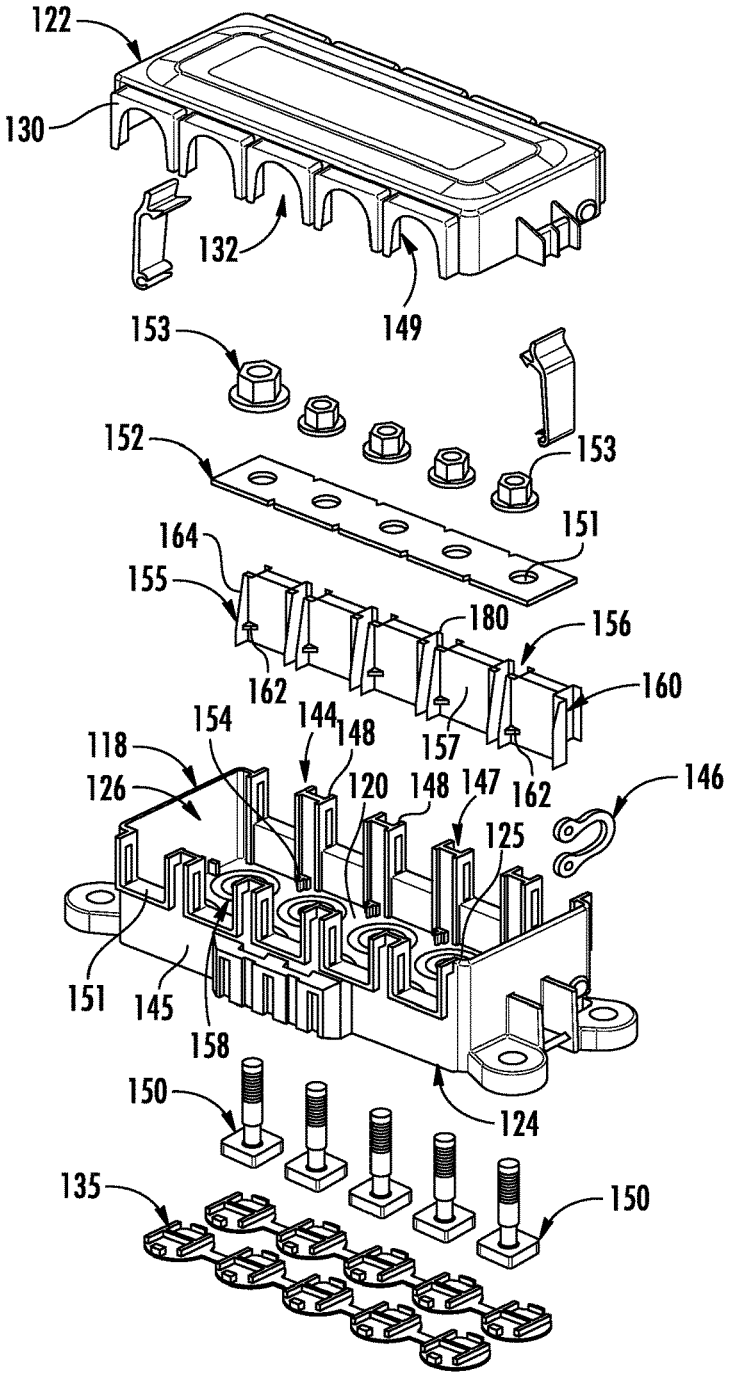
FIG. 6 is an exploded view of the fuse holder shown in FIG. 4 according to exemplary embodiments of the disclosure.
Figure 7:
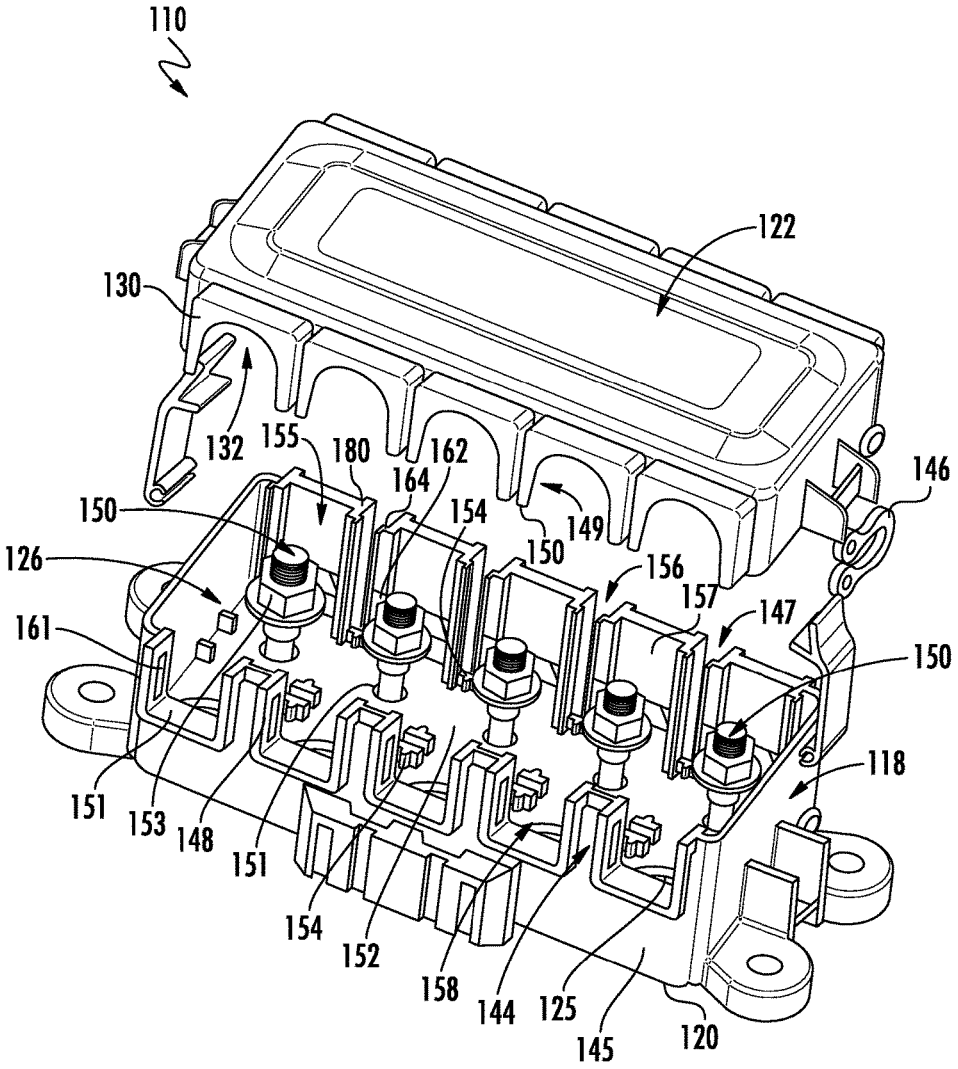
FIG. 7 is a partially exploded view of a fuse holder shown in FIG. 4 according to exemplary embodiments of the disclosure.

As better shown in FIG. 6, the side cover 155 may include a plurality of fuse supports 162 extending between the central block 157 and a fuse alignment wall 164. In some embodiments, each of the plurality of fuse supports 162 is a corner shelf or stop configured to engage a fuse (not shown) to keep the fuse in place without a nut. The plurality of fuse supports 162 of the side cover 155 may advantageously save assembly time because there's no need to unscrew the nut before attaching the wire. Furthermore, in some embodiments, with the fuses and the side cover 155 assembled, the busbar 152 may also be kept in place without any screw, snap-in locking or similar.

Figure 8:
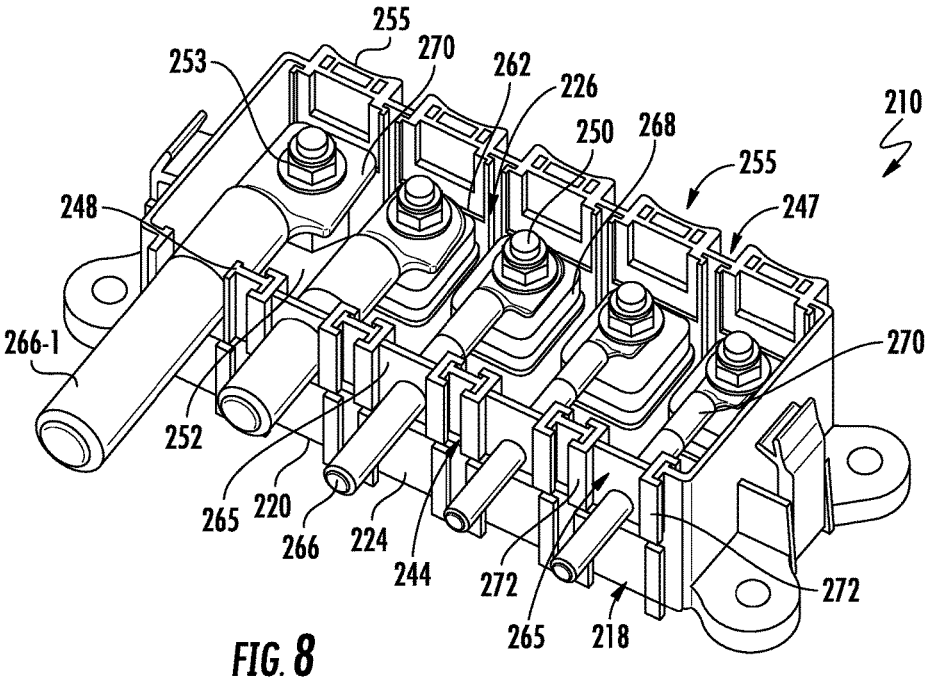
FIG. 8 is a perspective view of a circuit protection assembly according to exemplary embodiments of the disclosure.
Figure 9:
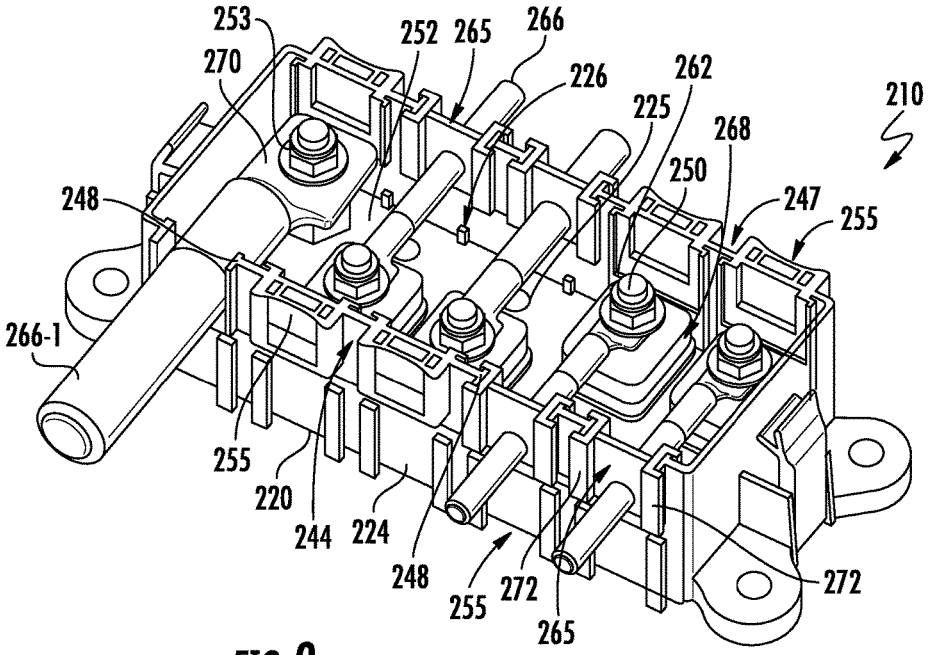
FIG. 9 is a perspective view of a circuit protection assembly according to exemplary embodiments of the disclosure.
Figure 10:
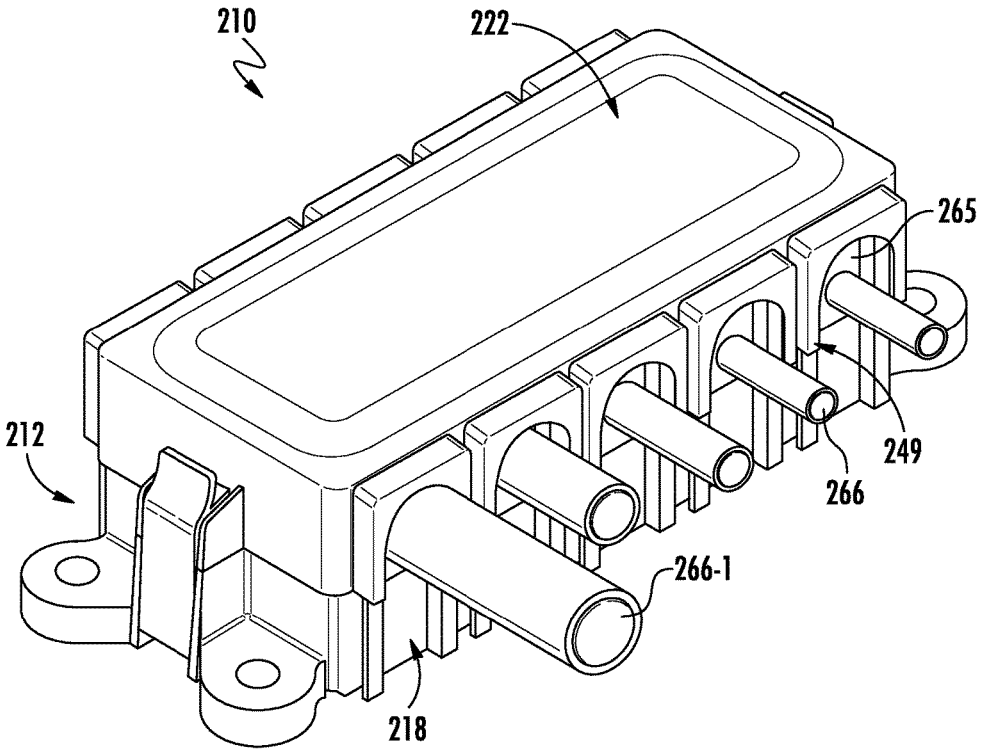
FIG. 10 is a perspective view of a circuit protection assembly according to exemplary embodiments of the disclosure.

Turning now to FIGS. 8-10, a circuit protection assembly (hereinafter "assembly") 210 according to embodiments of the present disclosure will be described in greater detail. As shown, the assembly 210 includes many the features previously described in relation to the assembly 10 and the assembly 110 and, as such, will not be described in full detail for the sake of brevity. The assembly 210 includes a housing assembly 212 having a base 218 coupled to a cover 222 (FIG. 10), the cover 222 removably connected to the base 218 and covering the components therein. As shown, the base 218 may include a set of sidewalls 224 extending from the lower wall 220. The lower wall 220 may include a plurality of bolt openings 225 (FIG. 6) provided therethrough. The plurality of bolt openings 225 permit one or more bolt assemblies 250 to extend into a cavity 226 defined by an open area within the base 218 and the cover 222.

As shown, the assembly 210 includes one or more bolt assemblies 250 extending through the plurality of bolt openings 225, as well as through a plurality of busbar openings 251 of a busbar 252. The busbar 252 may be disposed atop an upper/inner surface of the lower wall 220 of the base 218, wherein the plurality of busbar openings 251 may be aligned with one or more of the plurality of bolt openings 225 of the lower wall 220. In some embodiments, the bolt assemblies 250 may be secured in place by corresponding nuts 253.

The assembly 210 may include one or more side covers 255 coupleable with the base 218, the side cover 255 is configured to extend across one or more openings 258 between each of the plurality of pillar supports 244. As shown, the assembly 210 may further include one or more cable covers 265 extending over at least one of a plurality of openings between each of the plurality of pillar supports 244. The cable covers 265 include an opening for receiving a wire or cable 266. The cable covers 265 may further include a pair of slotted end walls 272 slidably engaged with the outer flanges 248 of the pillar supports 244. As will be appreciated, the cable covers 265 may act as debris covers for minimizing intrusion of dust or other contaminants into the base 218.

The side cover 255 may include a plurality of fuse supports 262, such as a corner shelf, tab, or stop configured to engage the fuse 268 to keep the fuse in place without a nut. The plurality of fuse supports 262 of the side cover 255 may advantageously save assembly time because there's no need to unscrew the bolt assembly 250 before attaching the wire or cable 266.

In some embodiments, the cable 266 and the bolt assembly 250 are coupled to a fuse 268, wherein the bolt assembly 250 is disposed through a receiving bore in the fuse 268. The fuse 268 may be a ceramic "block" fuse having a generally central aperture that receives the bolt assembly 250. In some embodiments, an insulator isolates the bolt assembly 250 from the fuse 268. A ring terminal 270, connected to the cable 266, is mounted over the bolt assembly 250, while the nut 253 threadedly engages the bolt assembly 250 to retain both the fuse 268 and the ring terminal 270 in position. As shown, the cables 266 may extend outside of the base 218 on either side, through the cable covers 265, thus providing increased design flexibility. In some cases, depending on the size of the ring terminal 270 and cable 266, no cable cover 265 is present between a pair of pillar supports 244. This is demonstrated with cable 266-1, which may be a relatively larger wire coupled to, e.g., an M10 bolt.

After the side cover 255 and the cable cover(s) 265 are coupled to the base 218, and the ring terminal 270 is secured in place with the nut 253, the cover 222 may be placed atop the base 218. That is, the middle slot 247 of each pillar support 244 is configured to receive one or more opening walls 249 of the cover 222. When cable covers 265 are present, the opening walls 249 may engage the pair of slotted end walls 272 to further secure the cable covers 265 to the base 218. Furthermore, with fuses 268 and the covers 222 and 255 assembled, the busbar 252 may also be kept in place without any screw, snap-in locking or similar, thus simplifying assembly and reducing cost.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The invention claimed is:

1. A fuse holder, comprising:

a base including a lower wall and a set of sidewalls, the lower wall including a plurality of bolt openings provided therethrough, wherein the set of sidewalls comprises a plurality of pillar supports defining a plurality of openings into an interior cavity, the interior cavity for housing a bolt assembly;

a cover securable with the base, the cover including an upper wall and a set of outer walls, the set of outer walls including a plurality of cable openings, wherein the base and the cover define the interior cavity; and a side cover coupled to the base, the side cover extending across at least one of the plurality of cable openings in the set of outer walls of the cover, wherein the side cover comprises a set of tabs for engaging a channel of one or more of the plurality of pillar supports to secure the side cover to the base.

2. The fuse holder of claim 1, further comprising a lower capping strip covering the plurality of bolt openings in the lower wall.

3. The fuse holder of claim 1, further comprising a busbar disposed atop the lower wall of the base, the busbar including a set of openings aligned with one or more of the plurality of bolt openings of the lower wall.

4. The fuse holder of claim 3, wherein the bolt assembly includes a nut securing the busbar to the bolt assembly.

5. The fuse holder of claim 3, further comprising a plurality of tabs extending from the lower wall of the base, the plurality of tabs mechanically coupling the busbar to the lower wall of the base.

6. The fuse holder of claim 1, further comprising a plurality of bolt assemblies extending into the interior cavity.

7. The fuse holder of claim 1, further comprising one or more cable covers extending over at least one of the plurality of cable openings in the set of outer walls of the cover.

8. A circuit protection assembly comprising:

a base including a lower wall and a set of sidewalls, the lower wall including a plurality of bolt openings provided therethrough, wherein the set of sidewalls comprises a plurality of pillar supports defining a plurality of openings into an interior cavity, the interior cavity for housing a bolt assembly;

a cover securable with the base, the cover including an upper wall and a set of outer walls, the set of outer walls including a plurality of cable openings, wherein the base and the cover define the interior cavity;

a plurality of bolt assemblies extending into the interior cavity; and a side cover coupled to the base, the side cover extending across at least one of the plurality of cable openings in the set of outer walls of the cover, wherein the side cover comprises a set of tabs for engaging a channel of one or more of the plurality of pillar supports to secure the side cover to the base.

9. The circuit protection assembly of claim 8, further comprising a lower cap covering the plurality of bolt openings in the lower wall.

10. The circuit protection assembly of claim 8, further comprising:

a busbar disposed atop the lower wall of the base, the busbar including a set of openings aligned with one or more of the plurality of bolt openings of the lower wall; and a plurality of tabs extending from the lower wall of the base, the plurality of tabs mechanically coupling the busbar to the lower wall of the base.

11. The circuit protection assembly of claim 10, wherein the plurality of bolt assemblies each include a nut coupled with the busbar.

12. The circuit protection assembly of claim 8, further comprising one or more cable covers extending over at least one of the plurality of cable openings in the set of outer walls of the cover.

13. A modular fuse holder assembly comprising:

a base including a lower wall and a set of sidewalls, the lower wall including a plurality of bolt openings provided therethrough, wherein the set of sidewalls comprises a plurality of pillar supports;

a cover securable with the base, the cover including an upper wall and a set of outer walls, the set of outer walls including a plurality of cable openings, wherein the base and the cover define an interior cavity, the pillar supports defining a plurality of openings into the interior cavity;

a plurality of bolt assemblies extending through the lower wall and into the interior cavity; and a side cover coupled to the base, the side cover extending across at least one of the plurality of cable openings in the set of outer walls of the cover, wherein the side cover comprises a set of tabs for engaging a channel of one or more of the plurality of pillar supports to secure the side cover to the base.

14. The modular fuse holder assembly of claim 13, further comprising a busbar disposed atop the lower wall of the base, the busbar including a set of openings aligned with one or more of the plurality of bolt openings of the lower wall.

* * * * *